United States Patent [19]

Meunier et al.

[11] 4,450,895

[45] May 29, 1984

[54] PROCESS AND APPARATUS FOR HEATING OR COOLING LIGHT SOLID PARTICLES

[75] Inventors: Georges Meunier, Boulogne, France; Maurice A. Bergougnou, London, Canada

[73] Assignee: Tunzini-Nessi Enterprises D'Equipements, Argenteuil, France

[21] Appl. No.: 317,326

[22] Filed: Nov. 2, 1981

[30] Foreign Application Priority Data

Nov. 5, 1980 [FR] France ..... 80 23570

[51] Int. Cl.³ ..... F28D 19/02

[52] U.S. Cl. ..... 165/1; 165/104.15; 165/104.18; 165/111; 432/215; 34/57 A

[58] Field of Search ..... 165/104.15, 104.18, 165/1, 111; 432/215; 34/57 A

[56] References Cited

U.S. PATENT DOCUMENTS

| | | | |
|---|---|---|---|
| 2,739,994 | 3/1956 | Bills | 260/679 |
| 3,029,484 | 5/1962 | Kutny | 22/89 |
| 3,051,466 | 8/1962 | Drew | 263/52 |
| 3,503,790 | 3/1970 | Gringras | 117/100 |
| 3,630,501 | 12/1971 | Shabaker | 165/104.18 X |
| 3,831,668 | 8/1974 | Weissenburg | 432/215 X |
| 4,369,834 | 1/1983 | Meunier et al. | 165/104.18 X |

FOREIGN PATENT DOCUMENTS

| | | |
|---|---|---|
| 1201476 | 2/1959 | France . |
| 487384 | 4/1970 | Switzerland . |

*Primary Examiner*—Albert W. Davis, Jr.
*Attorney, Agent, or Firm*—Pennie & Edmonds

[57] ABSTRACT

The invention discloses a process and apparatus for the heating or cooling of light solid particles having a low free-fall speed, by means of flowing gas-solid exchangers. The process makes it possible to heat or cool light solid particles dispersed in a gas flow by contacting them with a countercurrent flow of heavy solid particles having a greater final free-fall speed and that are hot or cool in relation to the light particles, thus effecting a heat transfer between the particles.

18 Claims, 4 Drawing Figures

PROCESS AND APPARATUS FOR HEATING OR COOLING LIGHT SOLID PARTICLES

TECHNICAL FIELD

This invention relates to a process and apparatus for heating or cooling light solid particles having a low terminal velocity or "free-fall" speed. More particularly, the invention concerns a process and apparatus for heating or cooling light solid particles by means of flowing gas-solid exchangers.

BACKGROUND OF THE INVENTION

Various heat treatment processes using gas-solid exchangers are already known and are described, for example, in French Serial No. 7,827,057. Generally, it is possible to contact a gas current, upwardly-moving along a baffled path, with solid particles circulating countercurrently in a loose gravity flow. This technique, however, is uneconomical for particles having free-fall speeds that are too low (less than 0.20 m/s). Particles having too small a density or granulometry cannot be effectively treated by this technique. Sand, for example, with a granulometry of 60 μm, represents a lower limit for particles that can be treated by these known methods. As the granulometries and/or densities of any given particles to be treated are reduced, their free-fall speed decreases. These factors demand an increase in the dimensions of the equipment, which inevitably leads to technological difficulties and excessive costs.

Some industries, such as the plaster, cement, alumina, bentonite or kieselguhr industries, or plants treating bituminous sands, have carried out heat treatments on large amounts of solids having very small granulometries. Until the present time, it has been necessary for these industries to use extremely bulky installations that are difficult to operate and in which moving gas-solid exchangers do not appear to be useable.

This invention is aimed at eliminating these various problems and providing a process and apparatus that allow the heating or cooling of light solid particles in relatively small equipment that has good heat efficiency and is easy to use.

DISCLOSURE OF THE INVENTION

This invention concerns a process for heating or cooling "light particles"having a low free-fall speed (due to their granulometry and/or their density.) The process unexpectedly uses moving gas-solid exchangers and includes a double heat transfer carried out by a flow of recyclable solid particles selected on the basis of a predetermined density and granulometry.

Process steps include the following: (a) the light solid particles are dispersed in a first gas current, (b) the first gas current containing the light particles and moving upward along a first baffled path, is contacted with solid particles characterized by a greater free-fall speed—"-heavy particles"—which are circulating countercurrently in a loose gravity flow, to effect a first heat transfer between the light particles in the first gas current and the heavy particles, (c) the heavy particles, having undergone the first heat transfer and circulating countercurrently in a loose gravity flow along a second baffled path, are contacted with an upwardly-moving second gas current, to effect a second heat transfer between the heavy particles and the second gas current, and (d) the heavy particles, having undergone the second heat transfer are reused in step (b).

After being dispersed in the first gas current, the light particles are carried upward pneumatically by the gas current in, for example, a packing column through which a flow of solid heavy particles (characterized in terms of granulometry, density and selected mechanical characteristics) runs countercurrently. When the light particles introduced are cold and the heavy particles hot, simultaneous cooling of the latter and heating of the former occurs. The carrier gas is heated at the same time as the light particles that it carries. The heavy particles, recovered cool, are again heated in a second heat exchanger, and are subsequently recycled to the first heat exchanger. Thus, it is possible to continuously carry out the heat transfer process on the light particles. Similarly, this invention permits the cooling of hot light particles by the use of recyclable cold heavy particles.

Heavy particles, having a free-fall speed value between about 10 and 100 times greater than that of the light particles, are advantageously used in the process. For the treatment of light particles having a free-fall speed of about 0.2 m/s at the lower ambient temperature, heavy particles having a free-fall speed between about 2 and 20 m/s, preferably between about 5 and 15 m/s, at the ambient temperature can be used.

According to the first embodiment of this invention, for the cooling of hot light solid particles: (a) the light particles are dispersed in a first gas current, (b) the first gas current containing the light particles and moving upward along a first baffled path, is contacted with colder heavy solid particles circulating countercurrently in a loose gravity flow, to effect a first heat transfer between the light particles in the first gas current and the heavy particles. The following are obtained: cooled light particles, a cooled first gas current and heated heavy particles, (c) the heated heavy particles, circulating countercurrently in a loose gravity flow along a second baffled path, are contacted with an upwardly-moving colder second gas current, to effect a second heat transfer between the heavy particles and the second gas current, thus obtaining cooled heavy particles and a heated second gas current, (d) the cooled heavy particles are reused in step (b), and (e) part of the heated second gas current becomes the first gas current, while the remainder is available for other uses.

A second embodiment of the invention permits the heating of cold light solid particles according to the following steps: (a) the light particles are dispersed in a first gas current, (b) the first gas current, containing the light particles and moving upward along a first baffled path, is contacted with hotter heavy solid particles, circulating countercurrently in a loose gravity flow, to effect a first heat transfer between the light particles in the first gas current and the heavy particles, thus obtaining heated light particles, a heated first gas current and cooled heavy particles, (c) the cooled heavy particles, circulating countercurrently in a loose gravity flow along a second baffled path, are contacted with a hotter upwardly-moving second gas current, to effect a second heat transfer between the heavy particles and the second gas current, thus producing heated heavy particles and a cooled second gas current, (d) the heated heavy particles are reused in stage (b), and (e) the heated first current is used to comprise at least part of the second gas current.

According to a variant of this last embodiment, cold light solid particles may undergo a flash heat treatment wherein: (a) the light particles are dispersed in a gas current, (b) the gas current, containing the light particles and moving upward along a first baffled path, is contacted with hotter heavy solid particles, circulating countercurrently in a loose gravity flow, to effect a first heat transfer between the light particles in the gas current and the heavy particles, thus obtaining a heated gas current containing heated light particles and cooled heavy particles, (c) the heated gas current containing the heated light solid particles undergoes a flash heat treatment, (d) the gas current, thus treated, moves upward along a second baffled path and is contacted with cooled heavy particles, circulating countercurrently in a loose gravity flow, to effect a second heat transfer between the heavy particles and the gas current carrying the treated light particles, thus obtaining heated heavy particles and a cooled gas current containing cooled treated light particles, and (e) the heated heavy particles are reused in stage (b). In some cases, the operation can be performed in a single column having the first baffled path in its lower part, means for supplying energy, such as burners, in its middle part and the second baffled path in its upper part.

The recycled heavy particles preferably comprise material that is resistant to attrition, having high density and approximately spherical shape. Spheres of sand, zircon or vitroceramic having a granulometry between about 1 and 2 mm and a density between about 2.5 and 3.8 g/cm$^3$, for example, give good results.

DESCRIPTION OF THE PREFERRED EMBODIMENTS

Figure 1:
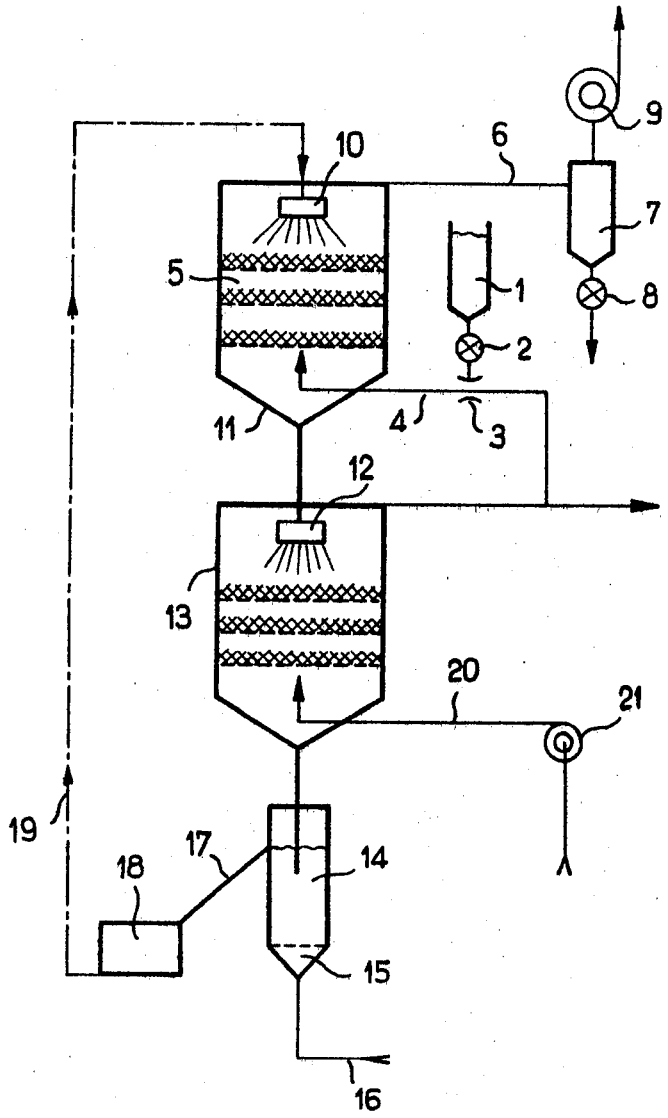
FIGS. 1 through 4 represent schematic views of different variants of an apparatus for use in the process according to the invention.

Referring to FIG. 1, the apparatus which is illustrated is designed to cool hot light solid particles, such as cement or alumina, that have undergone a previous treatment such as calcining in a rotary kiln or a fluidized bed.

Hot light particles (at a temperature between about 700° and 1100° C., for example) are collected in a hopper 1 and fed by a volumetric distribution system 2, such as a rotary chamber, an endless screw or a vibrating chute, into a venturi system 3 designed to ensure a pneumatic transfer by means of a current of hot air coming from a recovery device, which is described below.

The hot light particles which are dispersed in the hot air, are then brought by a pipe 4 to the lower part of a heat exchanger 5. The heat exchanger comprises a cylindrical or cylindroconical column provided with horizontal stages such as Pall rings, grids or sections in the filling body, as described in FR. Serial No. 7,827,057. The hot air, charged with hot light particles, rises against a flow of heavy particles having a free-fall speed between about 10 and 100 times that of the light particles. A systematic heat exchange takes place between these two flows, moving countercurrently in direct contact. The light particles and their carrier air, once cooled, escape at the top of the exchanger 5 by a pipe 6 and are collected in a cyclone 7 which separates them. The cooled light particles are delivered to the base of the cyclone by a rotary chamber 8, while the cooled carrier air escapes into the atmosphere through an exhaust fan 9, after optional filtration.

The flow of the cold heavy particles enters at the upper part of exchanger 5 via a rotary distributor 10, maintained at atmospheric tightness, such as that described in FR. Serial No. 7,818,291, and runs through the packing stages of the exchanger. In the exchanger, the flow of cold heavy particles crosses the flow of hot light particles carried pneumatically in the opposite direction, and a systematic heat exchange takes place between the two flows.

The heated heavy particles are then collected in a conical hopper 11 which forms the base of exchanger 5, subsequently reaching a rotary distributor 12 which is similar to distributor 10 (but may be made of a refractory alloy) and is located at the upper part of a second heat exchanger 13. Distributor 12 also functions as an atmospheric separation chamber between exchanger 5 and second exchanger 13.

The heavy particles stream through exchanger 13, which is similar to exchanger 5, encountering cold air flowing countercurrently from the base of the exchanger. The cold air gradually heats up, and once cooled, the heavy particles are collected in a fluidized trap 14 whose lower end 15, is equipped with a fluidization grate and receives air via a pipe 16. The heavy particles are drained off in the overflow by a pipe 17 to a storage reservoir 18, before being recycled by an elevator 19, such as a bucket lift, to distributor 10.

Cold air enters the lower part of exchanger 13 by a pipe 20, aided by the action of a fan 21 and is heated there by contact with the hot heavy particles. At the outlet of the production cycle, the heated air is divided into two parts: one of which is used to ensure the pneumatic transfer of the hot light particles at the input of the venturi 3, with the other part being used to feed the burners of a calciner or for other uses such as drying products at the input of the production cycle.

If it is assumed that the specific heats of the air, the light particles and the heavy particles are of the same magnitude, that the pneumatic transfer of the light particles requires weight for weight of air, and that the losses and the gas supplies from the fluidized traps are negligible, the mass flows permit a balanced heat distribution. For a unit of light particles to be cooled, the mass flows used are the following:

| | |
|---|---|
| light particles to be cooled | 1 unit |
| carrier air (which must be hot enough not to degrade the heat level) | 1 unit |
| recyclable heavy particles | 2 units |
| cold air introduced in exchanger 13 | 2 units |
| hot air for carrying light particles | 1 unit |
| hot air available for other uses representing, except for losses, the heat contained in the light particles. | 1 unit |

Given the possibility of relatively high free-fall speed of the heavy particles, for example, 5 to 15 m/s, the mass deliveries per surface unit of the exchanger can be pushed to very high levels, on the order of 5 to 10 T/h per m$^2$, allowing equipment having relatively moderate cross-sections.

Figure 2:
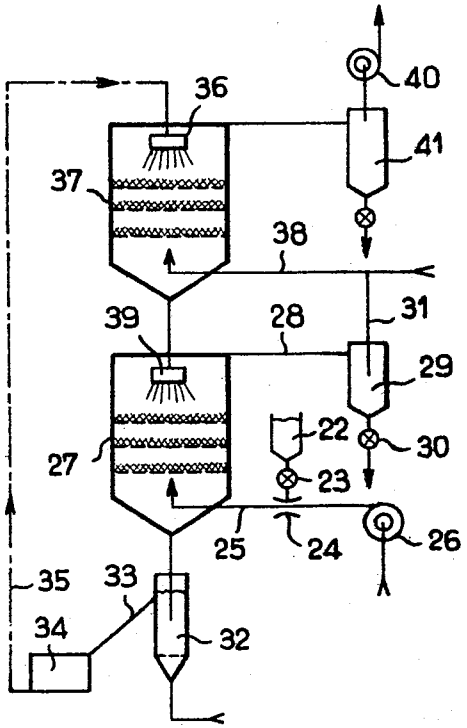

Referring to FIG. 2, the apparatus which is illustrated is designed to heat cool light particles, for example, before they are introduced into a calcining furnace, or to dry cool light particles.

Cold light particles stored in a hopper 22 are fed by a volumetric distribution device 23 into a venturi system 24 designed to ensure their dispersion and transfer by a pipe 25 into a flow of cold air coming from a fan 26. The particles, dispersed in the cold air, are brought to the lower part of a heat exchanger 27 comprising packing stages as in exchanger 5 of FIG. 1. The air charged with the light particles rises against a flow of hot heavy particles descending through the exchanger. A systematic heat exchange in a series of stages takes place between the two flows moving countercurrently in direct contact. The light particles and their carrier air, once heated, escape at the top of the exchanger 27 by a pipe 28 and are collected in a cyclone separator 29. The heated light particles are delivered to the base of the cyclone by a rotary chamber 30 from which they can be sent, suitably preheated, for further treatment in, for example, a calciner. The hot carrier air is carried by pipe 31 for reuse as indicated below.

Heavy particles collected cold at the lower part of the exchanger 27 in a fluidized trap 32, which is similar to trap 14 of FIG. 1, and which separates out any entrained light particles, flow through pipe 33 into a storage reservoir 34. The heavy particles are taken by a bucket lift 35 to a rotary distributor with atmospheric separation 36, which distributes the particles at the upper part of a heat exchanger 37, which is similar to exchanger 27. In the exchanger 37, the heavy particles are heated by a hot gas flowing countercurrently and introduced by a pipe 38 at the lower part of the exchanger. The heated gas flow may come from, for example, a calciner and from the air heated in exchanger 27, which has traversed pipe 31 for reuse.

The heavy particles, collected hot in the lower part of exchanger 37, directly feed a rotary distributor with atmospheric separation 39, which itself feeds exchanger 27, while the cooled gases escaping at the top of exchanger 37 are discharged to the atmosphere by a fan 40 after passing through a cyclone separator 41.

Given the assumptions made for the apparatus of FIG. 1, for a unit of light particles to be heated, the mass flows used are the following:

| | |
|---|---|
| Light particles to be heated | 1 unit |
| cold carrier air, subsequently recycled hot | 1 unit |
| additional warm gas or air | 1 unit |
| heavy particles in circulation | 2 units |
| cold air discharged from exchanger 37 | 2 units |

As demonstrated by the devices represented in FIGS. 1 and 2, the driving introductions and evacuations of gaseous fluids are always performed at a low temperature, eliminating the need for any special equipment. The relatively slight load losses of the exchangers permit operation at pressures or reduced pressures lower than one meter of water and requiring only simple fans. Thus, the circulation of hot gases in exchanger 37 of FIG. 2 is ensured by fan 40, located at the top of the exchangers and discharging cold air. Tightness at the intakes and outlets is ensured by the rotary chambers for the light particles, and by the fluidized traps and the distributors for the heavy particles. Since the heavy particles to be reused are recycled at low temperature, a simple machine such as a bucket lift, may be used to carry them back for use in the heat exchangers.

Figure 3:
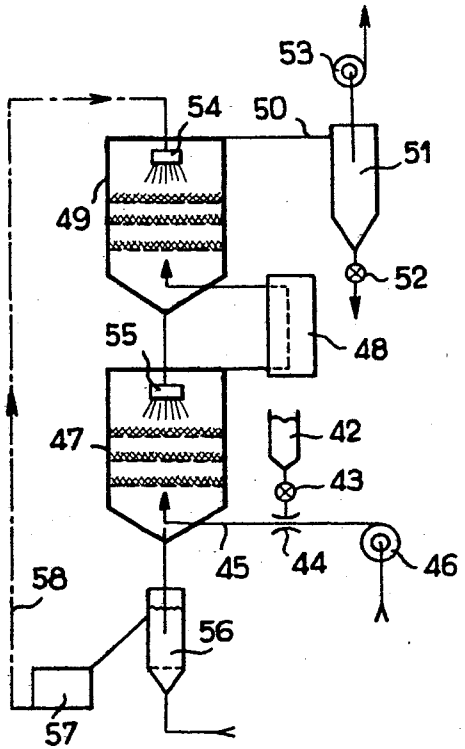

Referring to FIG. 3, the apparatus which is illustrated is designed for a relatively short treatment—on the order of 1 second—of light particles, such as calcining or "flash" drying.

The cold light particles to be treated, stored in a hopper 42, are fed by a volumetric distribution device 43 into a venturi system 44 designed to ensure their dispersion and transfer by a pipe 45 into a carrier flow of cold air coming from a fan 46. The particles, dispersed in the cold air, are brought to the lower part of a heat exchanger 47 which is similar to exchangers 13 and 27, previously described. The cold air charged with the light particles meets hot heavy particles flowing downward. The heated light particles and the carrier air exit at the upper part of exchanger 47 to pass through a flash heat or calcining treatment system 48 such as a carrier bed or an entraining co-current loop, to which energy is supplied by such means as, for example, an "air stream" type of burner. After leaving the flash heat or calcining treatment system, the mixture of treated light particles and hot carrier gases enters the base of a second heat exchanger 49, which is similar to those previously described. The cooled light particles are discharged by a pipe 50, separated from their carrier gases in a cyclone 51, and finally discharged by a rotary chamber 52. The gases are sent into the atmosphere, possibly by means of an exhaust fan 53.

The closed-circuit flow of the heavy particles is similar to that of the preceding variant. The heavy particles are introduced cold at the upper part of exchanger 49 by an atmospherically-tight rotary distributor 54. While passing through exchanger 49, the particles are heated, and are subsequently transferred by distributor 55 at the upper part of exchanger 47. The particles are discharged from the exchanger through trap 56 to storage reservoir 57 and recycling lift 58.

Figure 4:
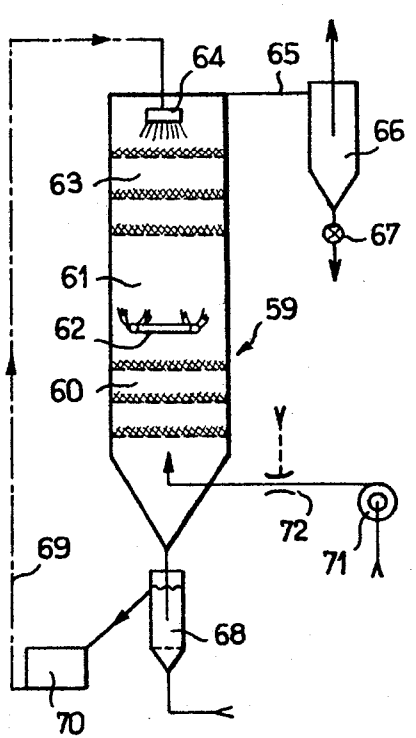

Referring to FIG. 4, the apparatus which is illustrated represents a simplified installment for treating solid light particles which require only a few fractions of a second of treatment such as, for example, fine particles which are polluted with combustible particles or heat sensitive particles. Essentially, the apparatus comprises a single column having a first baffled path in its lower part, means for supplying energy, such as burners, in its middle part and a second baffled path in its upper part.

The light particles to be treated are carried pneumatically as previously described and enter the base of a heat exchanger 59 which comprises three sections. In the lowest section 60, made up of packing stages of the type previously described, the light particles are gradually heated as they contact hot heavy particles descending through the exchanger. Upon entering the middle section 61 of the exchanger, which is a combustion area equipped with burners 62, such as annular-burners, the particles encounter hot gases coming from the burners and are thus brought to the desired temperature, such as 800° C. In the upper part 63 of the exchanger, which comprises packing stages similar to those used in the lower portion 60, the light particles are gradually cooled upon contacting cold heavy particles flowing downward from distributor 64. Subsequently, the light particles are discharged by a pipe 65, separated from their carrier air by a cyclone 66, and finally discharged by rotary chamber 67.

The heavy particles flow from distributor 64, through the exchange unit 63, 61, 60 and are discharged through trap 68. After intermediate storage in reservoir 70, the heavy particles are recycled by a lift 69. The movement of gases through the exchange column is effected by the action of a fan 71 feeding the venturi system 72 which introduces the fine particles.

The installations represented in each of FIGS. 1 through 4 do not require special equipment for the introduction and extraction of gaseous fluids or for recycling heavy particles, since the process can be carried out at a near-ambient temperature. The calorific energy needs of the apparatus are slight, since the transfer of energy effected by means of recyclable heavy particles promotes conservation of the required heat level, despite the previously mentioned losses.

In order to ensure heat transfer and to conserve the heat level, the process includes, as illustrated in FIG. 1, feeding a venturi system 3 with gas having a temperature that is in the range of that of the hot particles to be treated. For this purpose, a portion of the hot air escaping from exchanger 13 is removed.

The process and apparatus of this invention are advantageously applied in diverse industries such as those treating large tonnages of light solid particles. The invention is also advantageously used for calcining hydrated alumina, heating a hydrated product or cooling a calcined product. For alumina particles having a granulometry of 50 to 80 μm and a final free-fall speed between about 10 and 50 cm/s, zircon spheres of 1.2 to 1.6 mm in diameter having an average final free-fall speed of about 10 m/s are advantageously used as the recyclable heavy particles.

We claim:

1. A process for the heat transfer treatment of light solid particles having a low free-fall speed which comprises:

(a) dispersing the light particles in a first gas current;

(b) contacting the first gas current, containing the light particles and moving upward along a first baffled path in a reaction zone, with heavy solid particles having a greater free-fall speed and circulating countercurrently in the reaction zone in a loose gravity flow, to effect a first heat transfer between the light particles in the first gas current and the heavy particles;

(c) contacting the heavy particles, having undergone the first heat transfer and circulating countercurrently along a second baffled path in a loose gravity flow, with an upward-moving second gas current, to effect a second heat transfer between the heavy particles and the second gas current;

(d) recycling the heavy particles and (e) reusing the heavy particles in step (b).

2. A process for the heating of light solid particles which comprises:

(a) dispersing the light particles in a first gas current;

(b) contacting the first gas current, containing the light particles and moving upward along a first baffled path in a reaction zone, with hotter heavy solid particles having a greater free-fall speed and circulating countercurrently in the reaction zone in a loose gravity flow, to effect a first heat transfer between the light particles in the first gas current and the heavy particles to produce heated light particles, a heated first gas current and cooled heavy particles;

(c) contacting the cooled heavy particles, circulating countercurrently along a second baffled path in a loose gravity flow with a hotter, upward-moving, second gas current, to effect a second heat transfer between the heavy particles and the second gas current to produce heated heavy particles and a cooled second gas current;

(d) reusing said heated heavy particles in stage (b)

(e) recycling the cooled heavy particles in stage (c); and preferably (f) reusing the heated first gas current as a part of the second gas current in stage (c).

3. A process for the flash heat treatment or calcining of light solid particles which comprises:

(a) dispersing the light particles in a gas current;

(b) contacting the gas current, containing the light particles and moving upward along a first baffled path in a reaction zone, with hotter solid particles having a greater free-fall speed and circulating countercurrently in the reaction zone in a loose gravity flow, to effect a first heat transfer between the light particles in the gas current and the heavy particles to produce heated light particles, a heated gas current and cooled heavy particles;

(c) exposing the heated gas current containing the heated light particles to a flash heat or calcining treatment;

(d) contacting the gas current containing the heat treated light particles and moving upward along a second baffled path with cooled heavy particles, circulating countercurrently in a loose gravity flow, to effect a second heat transfer between the heavy particles and the gas current carrying the treated light particles to produce heated heavy particles, a cooled gas current and cooled light particles;

(e) recycling the cooled heavy particles; in stage (d)

(f) reusing the heated heavy particles in step (b).

4. A process for the flash heat treatment of light solid particles carried out in a single column having at least three heat transfer zones and which comprises:

(a) dispersing the light particles in a gas current;

(b) contacting the gas current, containing the light particles and moving upward along a first baffled path in a first heat transfer zone in the lower part of the column, with hotter heavy solid particles having a greater free-fall speed and circulating countercurrently in the column in a loose gravity flow, to effect a first heat transfer between the light particles in the first gas current and the heavy particles to produce heated light particles, a heated first gas current and cooled heavy particles;

(c) exposing the heated gas current containing the heated light particles to a flash heat treatment in an intermediate heat transfer zone;

(d) contacting the heated gas current, containing the heat treated light particles and moving upward along a second baffled path, in a third heat transfer zone in the higher part of the column with cooled heavy particles, circulating countercurrently in a loose gravity flow, to effect a second heat transfer between the heavy particles and the gas current carrying the treated light particles to produce heated heavy particles, a cooled gas current and cooled light particles;

(e) recycling the cooled heavy particles in stage (d)

(f) reusing the heated heavy particles in step (b).

5. Process according to one of claims 1, 2, 3 or 4, wherein the free-fall speed of the heavy particles is between about 10 and 100 times that of the light particles.

6. Process according to one of claims 1, 2, 3 or 4, wherein the heavy particles have a free-fall speed between about 2 and 20 m/s at the ambient temperature and the light particles have a free-fall speed below about 0.2 m/s at the ambient temperature.

7. Process according to one of claims 1, 2, 3 or 4, wherein the heavy particles have a free-fall speed between about 5 and 15 m/s at the ambient temperature.

8. Process according to one of claims 1, 2, 3 or 4, wherein the heavy particles comprise spheres of sand, zircon or vitroceramic having a granulometry between about 1 and 2 mm and a density between about 2.5 and 3.8 g/cm$^3$.

9. An apparatus for the heat transfer treatment of light solid particles having a low free-fall speed which comprises:

(a) means for dispersing the light particles in a first gas current;

(b) means for contacting the first gas current, containing the light particles and moving upward along a first baffled path in a reaction zone, with heavy solid particles having a greater free-fall speed and circulating countercurrently in the reaction zone in a loose gravity flow, to effect a first heat transfer between the light particles in the first gas current and the heavy particles;

(c) means for contacting the heavy particles, having undergone the first heat transfer and circulating countercurrently along a second baffled path in a loose gravity flow, with an upward-moving second gas current, to effect a second heat transfer between the heavy particles and the second gas current;

(d) means for recycling the heavy particles and (e) means for reusing the heavy particles in step (b).

10. An apparatus for the heating of light solid particles which comprises:

(a) means for dispersing the light particles in a first gas current;

(b) means for contacting the first gas current, containing the light particles and moving upward along a first baffled path in a reaction zone, with hotter heavy solid particles having a greater free-fall speed and circulating countercurrently in the reaction zone in a loose gravity flow, to effect a first heat transfer between the light particles in the first gas current and the heavy particles to produce heated light particles, a heated first gas current and cooled heavy particles;

(c) means for contacting the cooled heavy particles, circulating countercurrently along a second baffled path in a loose gravity flow with a hotter, upward-moving, second gas current, to effect a second heat transfer between the heavy particles and the second gas current to produce heated heavy particles and a cooled second gas current;

(d) means for reusing the heated heavy particles in stage (b)

(e) means for recycling the cooled heavy particles in stage (c); and, preferably, (f) means for reusing the heated first gas current as a part of the second gas current in stage (c).

11. An apparatus for the flash heat treatment or calcining of light solid particles which comprises:

(a) means for dispersing the light particles in a gas current;

(b) means for contacting the gas current, containing the light particles and moving upward along a first baffled path in a reaction zone, with hotter solid particles having a greater free-fall speed and circulating countercurrently in the reaction zone in a loose gravity flow, to effect a first heat transfer between the light particles in the gas current and the heavy particles to produce heated light particles, a heated gas current and cooled heavy particles;

(c) means for exposing the heated gas current containing the heated light particles to a flash heat or calcining treatment;

(d) means for contacting the gas current containing the heat treated light particles and moving upward along a second baffled path with cooled heavy particles, circulating countercurrently in a loose gravity flow, to effect a second heat transfer between the heavy particles and the gas current carrying the treated light particles to produce heated heavy particles, a cooled gas current and cooled light particles;

(e) means for recycling the cooled heavy particles;

(f) means for reusing the heated heavy particles in step (b).

12. An apparatus for the flash heat treatment of light solid particles carried out in a single column having at least three heat transfer zones and which comprises:

(a) means for dispersing the light particles in a gas current;

(b) means for contacting the gas current, containing the light particles and moving upward along a first baffled path in a first heat transfer zone in the lower part of the column, with hotter heavy solid particles having a greater free-fall speed and circulating countercurrently in the column in a loose gravity flow, to effect a first heat transfer between the light particles in the gas current and the heavy particles to produce heated light particles, a heated gas current and cooled heavy particles;

(c) means for exposing the heated gas current containing the heated light particles to a flash heat treatment in an intermediate heat transfer zone;

(d) means for contacting the heated gas current, containing the heated light particles and moving upward along a second baffled path, in a third heat transfer zone in the higher part of the column with cooled heavy particles, circulating countercurrently in a loose gravity flow, to effect a second heat transfer between the heavy particles and the gas current carrying the treated light particles to produce heated heavy particles, a cooled gas current and cooled light particles;

(e) means for recycling the cooled heavy particles.

13. Apparatus for the treatment of light solid particles according to one of claims 9, 10, 11, 12, wherein the heat exchanger or heat exchangers comprise a column having packing elements which impose a baffled path on the particles moving through the exchangers.

14. The apparatus according to claim 13 wherein tightness at the dispersion and recycling points for the heavy particles is ensured by fluidized traps and rotary distributors.

15. The apparatus according to claim 13 wherein tightness at the dispersion and recycling points for the light particles is ensured by rotary chambers.

16. The apparatus according to claim 13 wherein the means for recycling the cooled heavy particles is a bucket lift.

17. A process for the cooling of hot light solid particles which comprises:

(a) dispersing the light particles in a first gas current;

(b) contacting the first gas current, containing the light particles and moving upward along a first baffled path in a reaction zone, with colder heavy solid particles having a greater free-fall speed and circulating countercurrently in the reaction zone in a loose gravity flow, to effect a first heat transfer between the light particles in the first gas current and the heavy particles to produce cooled light particles, a cooled first gas current, and heated heavy particles;

(c) contacting the heated heavy particles, circulating countercurrently along a second baffled path in a loose gravity flow with a colder, upward-moving, second gas current, to effect a second heat transfer between the heavy particles and the second gas current to produce cooled heavy particles and a heated second gas current;

(d) recycling the cooled heavy particles;

(e) reusing the cooled heavy particles in stage (b); and (f) reusing a portion of the heated second gas current as a first gas current.

18. An apparatus for the cooling of hot light solid particles which comprises:

(a) means for dispersing the light particles in a first gas current;

(b) means for contacting the first gas current, containing the light particles and moving upward along a first baffled path in a reaction zone, with colder heavy solid particles having a greater free-fall speed and circulating countercurrently in the reaction zone in a loose gravity flow, to effect a first heat transfer between the light particles in the first gas current and the heavy particles to produce cooled light particles, a cooled first gas current and heated heavy particles;

(c) means for contacting the heated heavy particles, circulating countercurrently along a second baffled path in a loose gravity flow with a colder, upward-moving, second gas current, to effect a second heat transfer between the heavy particles and the second gas current to produce cooled heavy particles and a heated second gas current;

(d) means for recycling the cooled heavy particles;

(e) means for reusing the cooled heavy particles in stage (b); and (f) means for reusing a portion of the heated second gas current as a first gas current.

* * * * *